US006308643B1

(12) United States Patent
Cummings

(10) Patent No.: US 6,308,643 B1
(45) Date of Patent: Oct. 30, 2001

(54) PORTABLE UNIVERSALLY ADAPTABLE WORKSTATION EXTENSION

(76) Inventor: Val Cummings, 117 Mado Ct., Aberdeen, WA (US) 98520-5128

( * ) Notice: Subject to any disclaimer, the term of this patent is extended or adjusted under 35 U.S.C. 154(b) by 0 days.

(21) Appl. No.: 09/513,289

(22) Filed: Feb. 24, 2000

Related U.S. Application Data

(60) Provisional application No. 60/121,459, filed on Feb. 24, 1999.

(51) Int. Cl.[7] ..... A47B 1/04
(52) U.S. Cl. ..... 108/69
(58) Field of Search ..... 108/69, 97, 98, 108/134, 135, 152; 248/918, 917; 100/90

(56) References Cited

U.S. PATENT DOCUMENTS 720,033 * 2/1903 Kelly ..... 108/97
5,205,222 * 4/1993 Bernard ..... 108/97
5,282,427 * 2/1994 Steinhilber ..... 108/97
5,373,794 * 12/1994 Wiberg ..... 108/69
5,443,237 * 8/1995 Stadtmauer ..... 248/918 X
5,549,054 * 8/1996 Lewis ..... 108/152
5,995,082 * 11/1999 Lakoski ..... 248/918 X
6,148,739 * 11/2000 Martin ..... 248/918 X

* cited by examiner

*Primary Examiner*—Jose V. Chen
(74) *Attorney, Agent, or Firm*—Dean A. Craine

(57) ABSTRACT

A computer workstation extension designed to be used with a variety of different desks, tables and counters. The extension includes a rectangular-shaped planar member. Formed or attached to one end of the planar member is a longitudinally aligned overlapping lip member designed to be placed over the top surface of the desk, table or counter. In the preferred embodiment, a recessed space is formed over the lip member which is designed to receive a mouse pad. During use, the top surface of the planar member and the mouse pad are aligned and registered to form a flat, continuous work surface. The planar member is adjustably attached to the edge of the desk, table or counter by two single or bi-directional clamps located on the bottom surface of the planar member. The bi-directional clamps enable the extension to attach to different sized and shaped edges. Attached to the bottom surface of the planar member near the distal end is a pivotal leg designed to horizontally support the distal end of the planar member during use.

3 Claims, 4 Drawing Sheets

PORTABLE UNIVERSALLY ADAPTABLE WORKSTATION EXTENSION

This is a utility patent application based on a provisional patent application (Ser. No. 60/121,459) filed on Feb. 24, 1999.

BACKGROUND OF THE INVENTION

1. Field of the Invention

This invention relates to workstation or tabletop extensions, and, more particularly, to extensions that are portable and universally adaptable to be used with different workstations or tables.

2. Description of the Related Art

It is widely known that the work area around a desktop or lap top computer can be crowded. In many instances, there is little or no room on the work area to support or rest the operator's arms or hands while typing on the keyboard or to operate a mouse. As a result, many operators have wrist injuries and are frustrated when operating a mouse.

There are many different styles of desks and tables on which a desk or lap top computer may be placed. For example, some desks or tables have tops with square or round edges that extend outward. The thickness of the desktop or tabletop can also vary greatly.

What is needed is a portable, universally adaptable workstation extension that provides a temporary support and work area system for a desk or table.

SUMMARY OF THE INVENTION

It is an object of the present invention to provide a portable workstation extension capable of supporting a user's arm or wrist while using a computer.

It is an object of the present invention to provide such a workstation specifically designed to be used with a mouse.

It is another object of the present invention to provide such an extension that is universally adaptable for different types of desks, tables and counters.

These and other objects are met by a portable, universally adaptable workstation extension designed to be used with a variety of different desks, tables and counters. The extension includes a rectangular shaped, planar member that attaches to the side of the desk, table or counter. Formed or attached to one end of the planar member is a longitudinally aligned, overlapping lip member designed to be placed over the top surface of the desk, table or counter. Formed over the lip member is a recessed receiving space for a mouse pad. When a mouse pad is placed in the receiving space, the top surfaces of the planar member and mouse pad are aligned to form a planar, continuous support surface. In one embodiment, the extension is adjustably attached to the edge of the desk, table or counter by two bi-directional clamps attached to the bottom surface of the planar member. The bi-directional clamps enable the planar member to attach to different size and shape edges. Also attached to the bottom surface of the planar member near the distal end thereof is a selectively positioned leg designed to horizontally support the distal end of the planar member during use.

DESCRIPTION OF THE PREFERRED EMBODIMENT(S)

Figure 1:
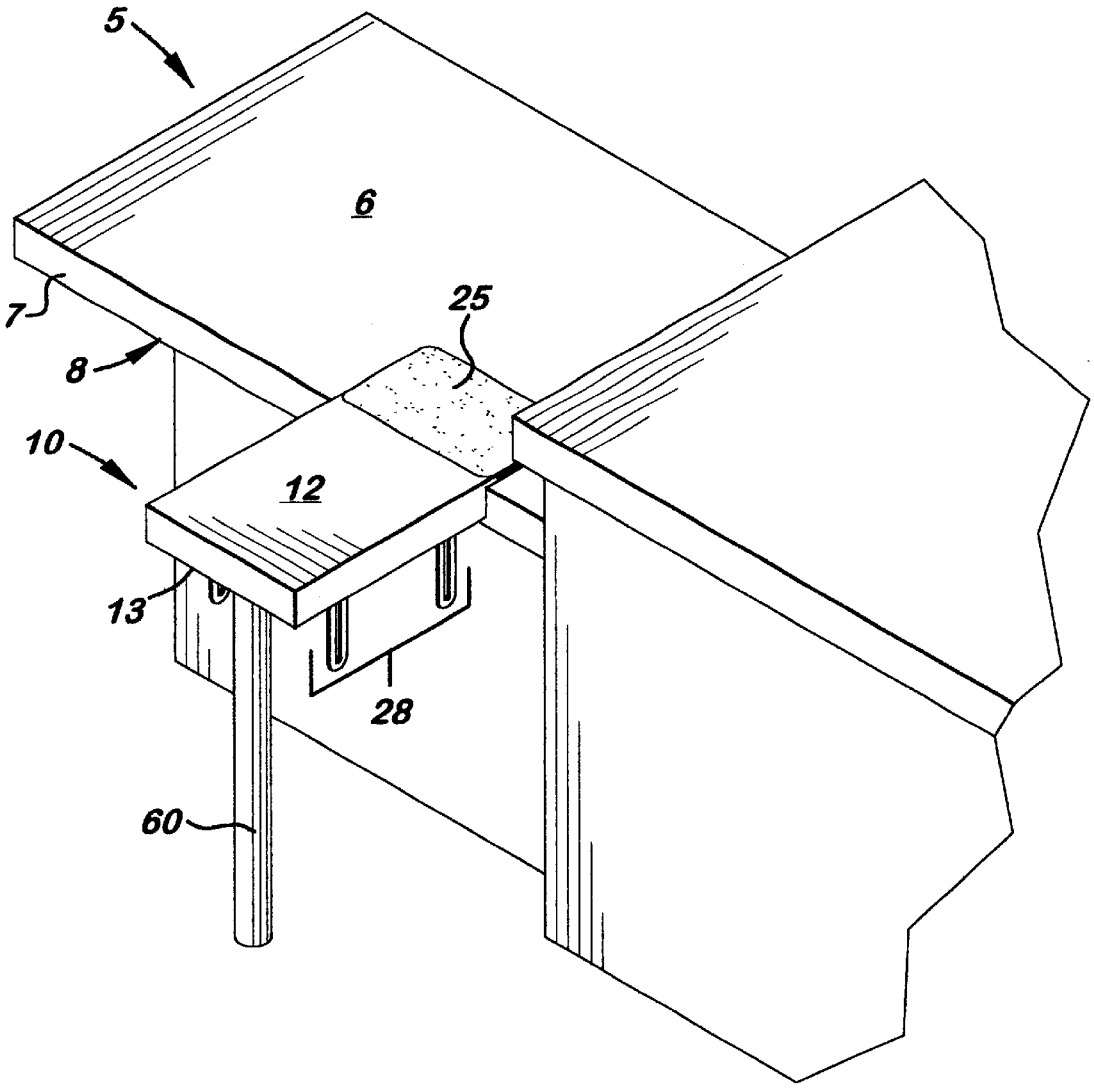
FIG. 1 is a perspective view of the extension attached to a work counter.
Figure 2:
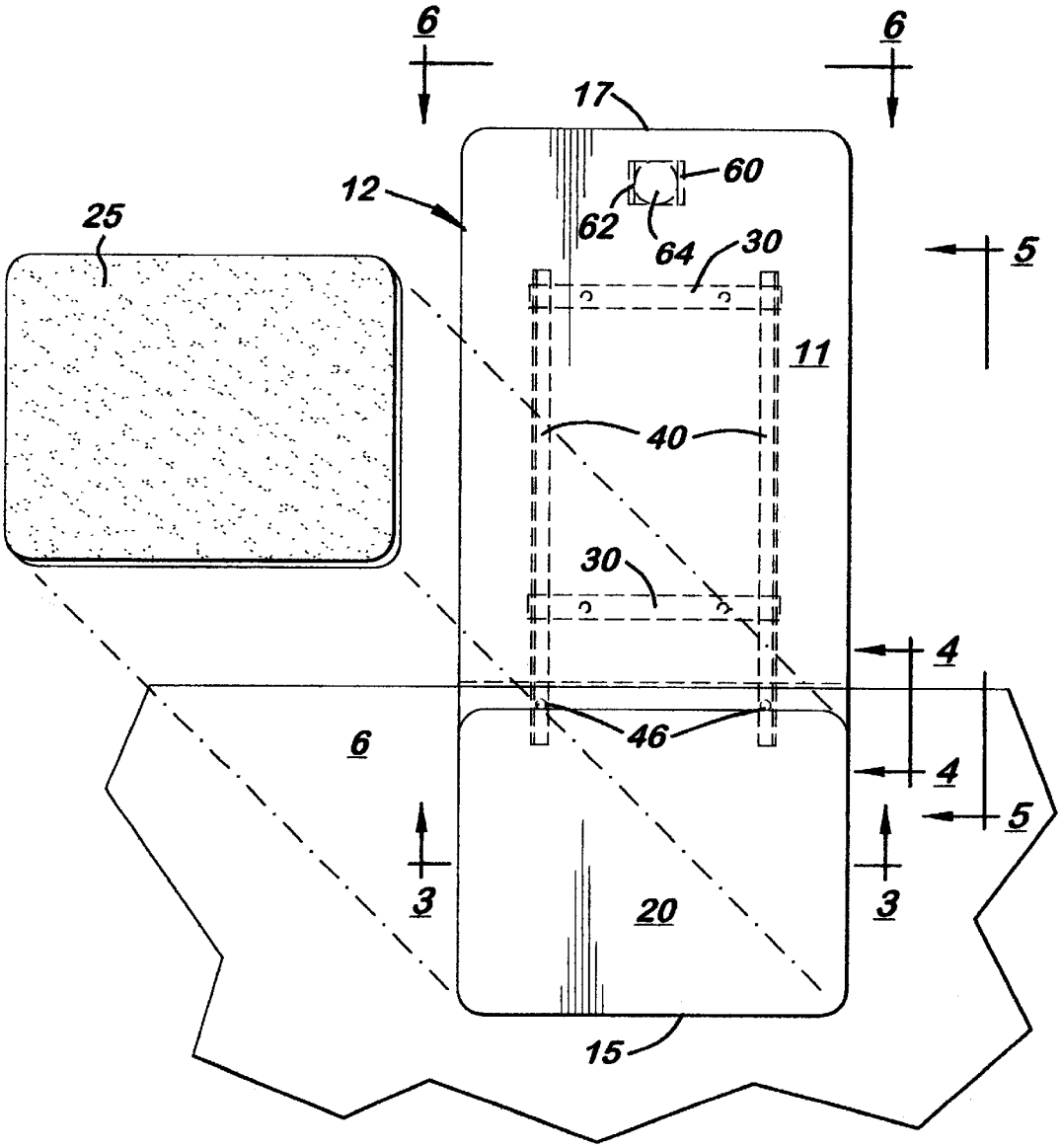
FIG. 2 is a top plan view of the extension shown in FIG. 1.
Figure 3:
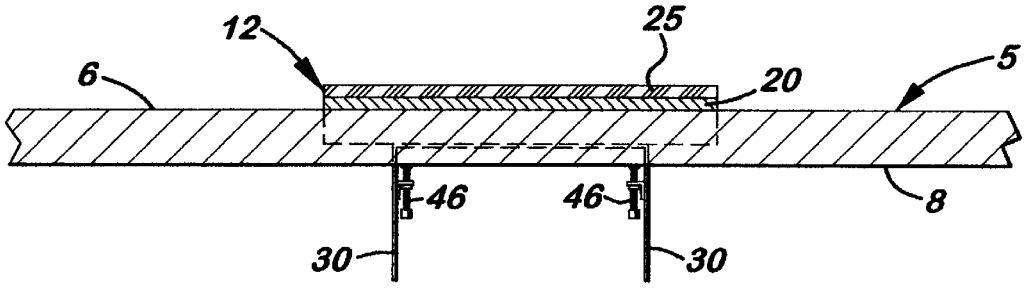
FIG. 3 is a sectional, front elevational view taken along line 3—3 in FIG. 2.
Figure 4:
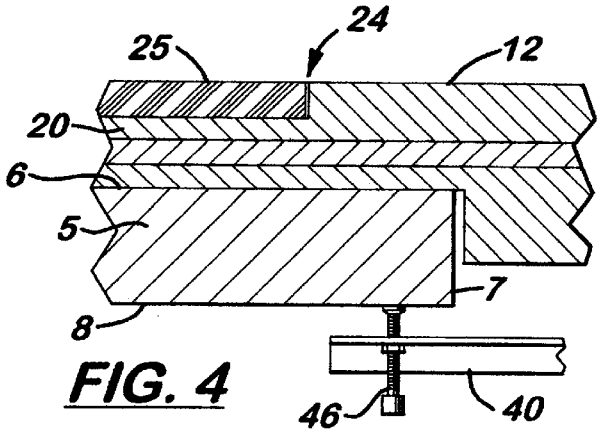
FIG. 4 is a sectional, side elevational view taken along line 4—4 in FIG. 2.
Figure 5:
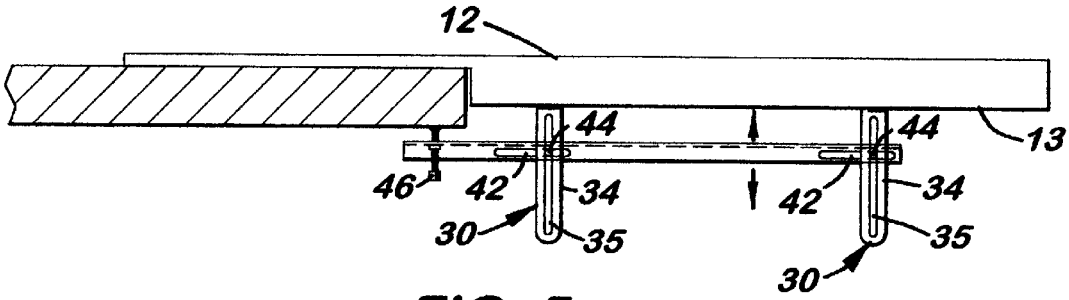
FIG. 5 is a sectional, side elevational view taken along line 5—5 in FIG. 2.

In the accompanying FIGS. 1–9, there is shown a portable, universally adaptable workstation extension 10 designed to be used with a variety of different desks, tables and counters, generally denoted as 5, hereinafter called a desk. As shown in FIG. 2, the extension 10 includes a rectangular-shaped, planar member 12. Formed or attached to the proximal end 15 of the planar member 12 is a longitudinally aligned lip member 20 designed to be placed over the top surface 6 of the adjacent desk 5. The lip member 20 is thinner than the planar member 12, and the bottom surface of the lip member 20 is aligned with the bottom surface of the planar member 12 thereby forming a recessed receiving space 24 for a mouse pad 25. In the preferred embodiment, the depth of the receiving space 24 is sufficient to form a flat planar support surface to fully support the user's arm when a standard thickness mouse pad is placed inside the receiving space 24.

In the first embodiment shown in FIGS. 1–7, the extension 10 is selectively attached to the edge 7 of the desk 5 by two bi-directional clamps 28 located on the bottom surface 13 of the planar member 12. The bi-directional clamp 28 enables the extension 10 to attach to different desk thicknesses and shaped edges 7. The bi-directional clamps 28 include U-shaped members 30 spaced apart and attached to the bottom surface 13 of the planar member 12. Each U-shaped member 30 includes a transverse member 32 that is directly attached via screws 33 in a transversely aligned position to the bottom surface 13 of the planar member 12. Each U-shaped member 30 also includes two integrally formed legs 34 that extend downward and perpendicular to the transverse member 32. Each leg 34 includes a longitudinally aligned slot 35.

The bi-directional clamps 28 also include two bars 40 that interconnect the two legs 34 on each side of the planar member 12. Each bar 40 includes two longitudinally aligned slots 42 and a threaded clamping member 46 that is pressed against the bottom surface 8 of the desk 5. During assembly, a bar 40 is attached to the legs 34 on each side of the planar member 12 via bolts 44 and nuts (not shown) to interconnect the legs 34 and bar 40. The bar 40 may be moved vertically and horizontally to a desired position.

Figure 6:
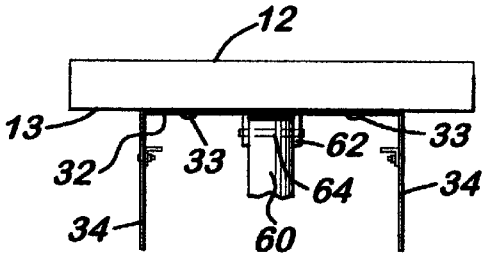
FIG. 6 is a side elevational view taken along line 6—6 in FIG. 2.
Figure 7:
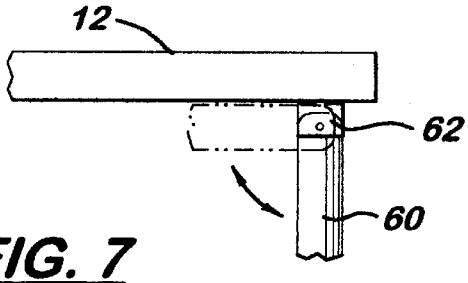
FIG. 7 is a side elevational view showing the pivoting movement of the leg.

Attached to the bottom surface 13 of the planar member 12 near its distal end 17 is an adjustable leg 60 designed to horizontally support the distal end 17 of the planar member 12 during use. As shown in FIGS. 6 and 7, the leg 60 is attached to a bracket 62 via a bolt 64 that enables the leg 60 to rotate 90 degrees between positions perpendicular and parallel to the planar member 12.

Figure 8:
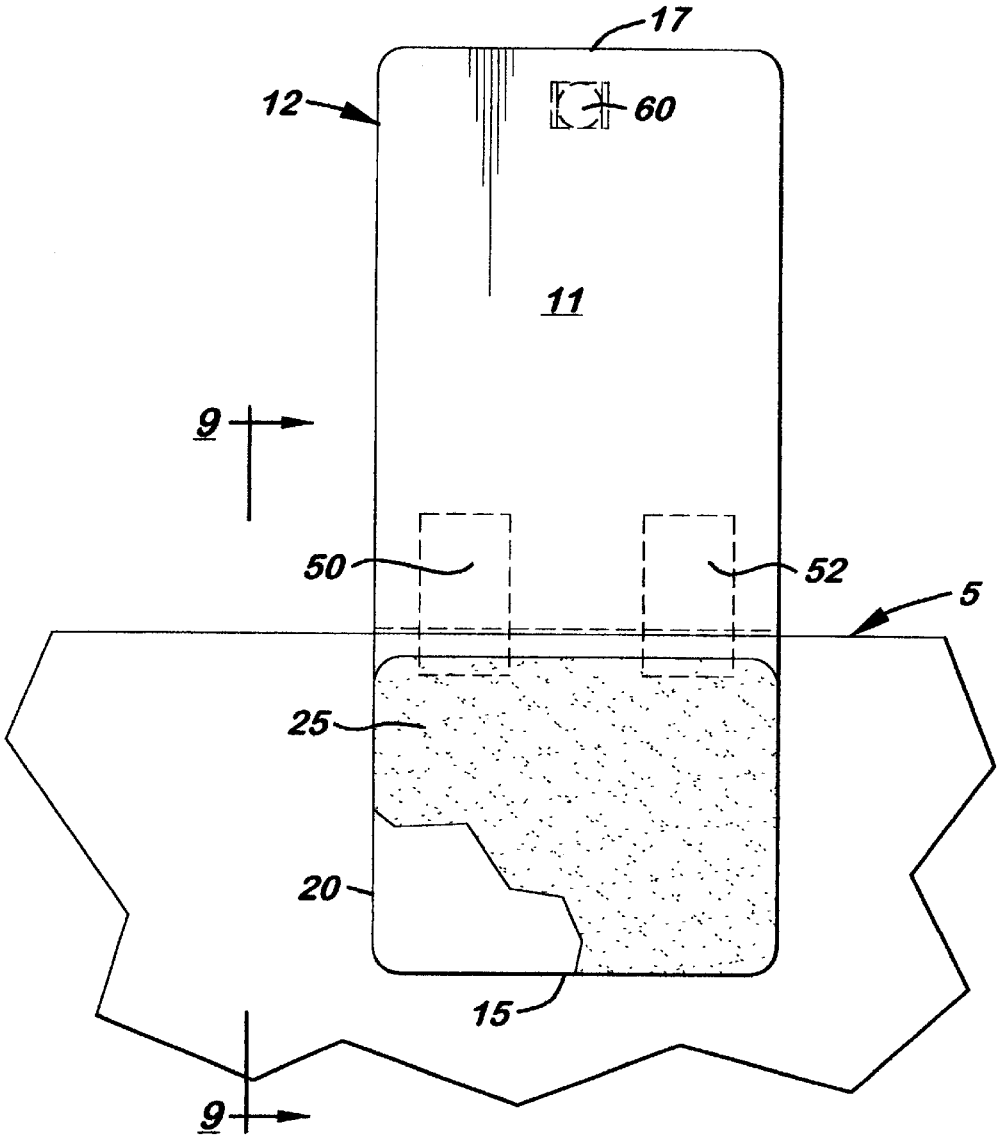
FIG. 8 is a top plan view of another embodiment of the invention that uses two, single directional adjustable clamps.
Figure 9:
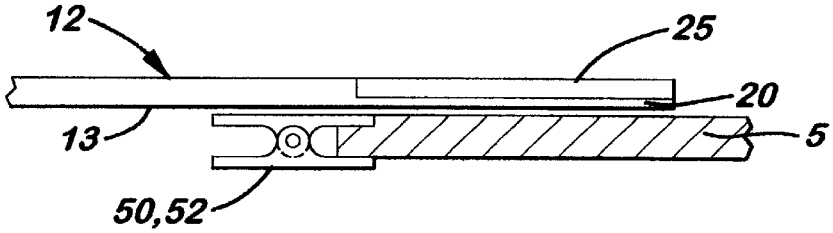
FIG. 9 is a sectional, side elevational view taken along line 9—9 in FIG. 8.

FIGS. 8 and 9 show a second embodiment of the workstation extension 10, wherein the bi-directional clamps 28 are replaced with two, single directional, adjustable pivoting clamps 50 and 52. The clamps 50, 52 are spaced apart and securely attached to the bottom surface 13 of the planar member 12. The clamps 50, 52 are manually operated and sufficient in size to attach the edge of a desk or tabletop approximately 1 inch in thickness.

The planar member 12 is made of an inner rigid member, such as wood or aluminum layer covered by a top and bottom plastic layered. In the preferred embodiment, the planar member 12 measures approximately 18 to 24 inches inch length, 6 to 12 inches in width and ¾ to 1½ in thickness. The receiving space 24 measures approximately 6 to 12 inches in length, 6 to 12 inch in width, and ¼ to ½ inches in depth. The lip member 20 is approximately ½ to 1 inch in thickness. The adjustable leg is made of aluminum and measures approximately ¾ to 1 inch in diameter and 24 to 29 inches in length.

The legs 34 on the U-shaped members 30 are approximately 6 inches in length. The slots 35 formed on each leg 34 are approximately ⅜ inch in width and 5 inches in length. The bar 40 is approximately 18 inches in length with the slots 42 being approximately ⅜ inch in width and 4 inches in length. During use, the bars 40 may be adjusted on the legs 34 so that the angle of the top surface 11 of the planar member 12 relative to the bars 49 may be adjusted up to approximately 30 degrees.

In compliance with the statute, the invention has been described herein in language more or less specific as to structural features. It should be understood, however, that the invention is not limited to the specific features shown, since the means and construction shown comprise only some of the preferred embodiments for putting the invention into effect. The invention is, therefore, claimed in any of its forms or modifications within the legitimate and valid scope of the amended claims, appropriately interpreted in accordance with the doctrine of equivalents.

I claim:

1. A computer workstation extension comprising:

a. a planar member having a top surface, a bottom surface, a proximal end and a distal end;

b. a longitudinally aligned recessed mouse pad receiving space formed on said distal end of said planar member;

c. a mouse pad placed in said mouse pad receiving space;

d. an adjustable clamping means attached to said planar member enabling said planar member to be selectively attached to an edge on a workstation, said clamping means capable of being adjusted to attach to edges having different thickness; and e. a leg attached to said planar member near said distal end.

2. The computer workstation extension, as recited in claim 1, wherein said clamping means is bi-directional and capable of being vertically and longitudinally adjusted.

3. The computer workstation extension, as recited in claim 1, wherein said leg is pivotally attached to said planar member.

* * * * *